US006088977A

United States Patent [19]

Lawrence

[11] Patent Number: 6,088,977

[45] Date of Patent: Jul. 18, 2000

[54] METHOD AND APPARATUS FOR MAKING STAIRS

[76] Inventor: Michael J. Lawrence, P.O. Box 1118, Sisters, Oreg. 97759

[21] Appl. No.: 08/961,847

[22] Filed: Oct. 31, 1997

[51] Int. Cl.[7] ..... E04F 21/26

[52] U.S. Cl. ..... 52/182; 52/184; 52/190; 52/191; 52/105

[58] Field of Search ..... 52/182, 183, 190, 52/191, 712, 105, 184; 33/476

[56] References Cited

U.S. PATENT DOCUMENTS

| | | | |
|---|---|---|---|
| 697,434 | 4/1902 | Beardsley | 52/182 |
| 1,241,976 | 10/1917 | Hill | 33/476 |
| 1,925,642 | 9/1933 | Meredith . | |
| 2,287,561 | 6/1942 | Page et al. | 52/182 |
| 2,297,101 | 9/1942 | Greenwell et al. | 52/182 |
| 2,724,466 | 11/1955 | Phillips . | |
| 2,818,945 | 1/1958 | Holzer | 52/191 |
| 3,999,350 | 12/1976 | MacKenzie | 52/105 X |
| 4,015,687 | 4/1977 | Dean . | |
| 4,106,591 | 8/1978 | Cohen et al. . | |
| 4,367,613 | 1/1983 | Strub | 52/188 |
| 4,583,334 | 4/1986 | Hubbard | 52/98 |
| 4,635,416 | 1/1987 | Ayala . | |
| 4,709,520 | 12/1987 | Vochatzer . | |
| 4,866,894 | 9/1989 | Brown . | |
| 4,875,315 | 10/1989 | Champagne . | |
| 5,140,755 | 8/1992 | Simmons, Jr. | 33/476 |
| 5,205,093 | 4/1993 | Schuette . | |
| 5,613,341 | 3/1997 | Skillern | 52/741.2 |
| 5,636,483 | 6/1997 | Wille | 52/183 |
| 5,791,101 | 8/1998 | Wallace | 52/182 |

*Primary Examiner*—Christopher T. Kent
*Assistant Examiner*—Jennifer I. Thissell
*Attorney, Agent, or Firm*—Kolisch Hartwell Dickinson McCormack & Heuser

[57] ABSTRACT

A bracket for use in manufacturing a step supported by a stringer. The bracket includes an anchor block to which a tread for a step may be attached, a pair of frames flanking the anchor block and fixed thereto, and markings formed on at least one of the frames. The markings indicate a rise and a run for the step. The bracket may be used in a method for building a stairs. The method includes the steps of selecting a desired tread distance and rise distance for the stairs to be built, fastening tread receiving portions and riser-receiving portions of a bracket to a first elongate stringer to define the desired tread and riser distances, repeating the above steps with respect to a second stringer, mounting a tread to the tread-receiving portions, and mounting a riser to the riser-receiving portions.

16 Claims, 3 Drawing Sheets

Fig. 3
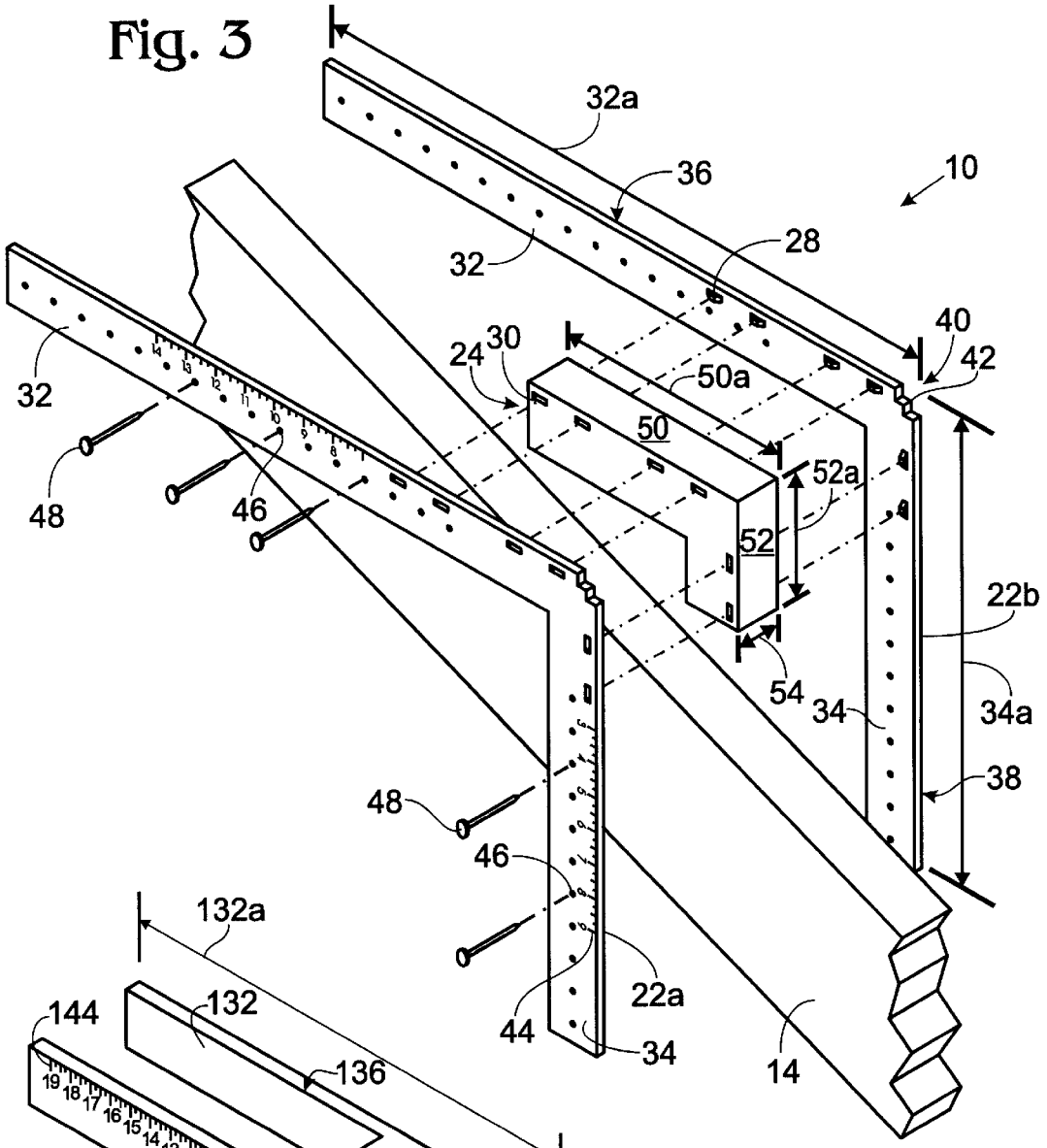
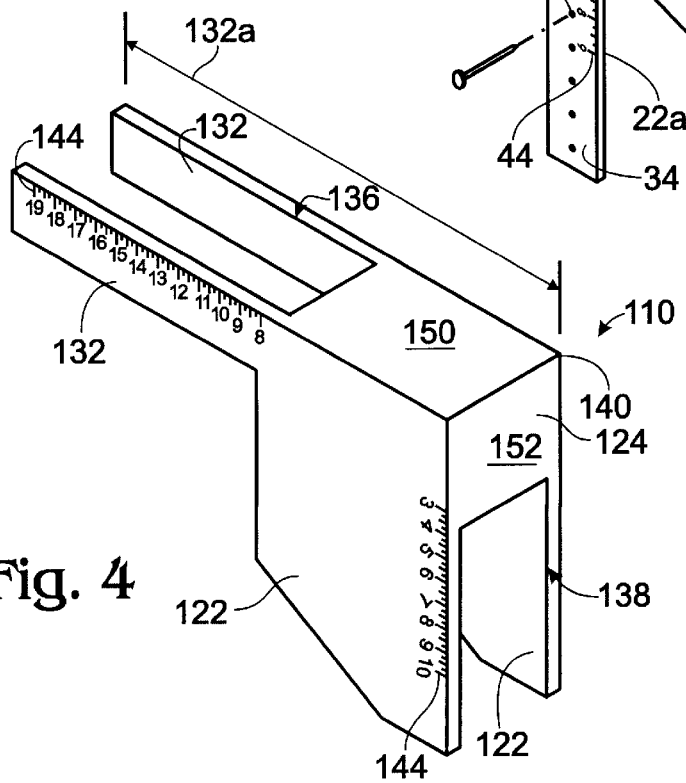
Fig. 4

METHOD AND APPARATUS FOR MAKING STAIRS

BACKGROUND OF THE INVENTION

The present invention relates generally to a method and apparatus for making stairs, and more specifically to a bracket for use in manufacturing a step supported by a rectilinear stringer. The invented method and apparatus allow rapid, efficient, accurate, and economical construction of stairs, whether the stairs include a single step or an entire flight of steps. The invented apparatus is surprisingly adaptable to a variety of stairways, and has the unique advantage of producing steps that are incredibly quiet and squeak-free.

Conventional stairs for residential construction include a stringer made from a 2×12 piece of wood, with triangular portions of the stringer cut away to define the rise and run of each step. This construction requires that each triangle of removed material be marked and cut separately, involving much labor and presenting numerous opportunities for error and injury. It also results in a stringer having an effective structural thickness of only about half the thickness of the original 2×12 piece of lumber, with approximately one-quarter of the original 2×12 piece being thrown away and therefore wasted.

In the prior art, numerous attempts have been made to solve the problem of producing stairs more accurately, reliably, efficiently, and economically than the conventional 2×12 cut-away stringer method described above. One possible solution is to produce stairs in a factory. Through economies of scale, stairs could be pre-manufactured accurately and reliably. However, pre-manufactured stairs would be difficult to ship and install, given the significant weight and size of a completed stairs. It also would be difficult to accommodate the variables found in a typical building environment. These variables include the vertical and horizontal distance between the floors to be spanned by the stairs, and the materials to be used as the tread and riser for the stairs.

Other attempts at solving the problems of conventional construction techniques for stairs take a modularized approach. Two examples of modularized stairs are shown in U.S. Pat. Nos. 1,925,642 and 4,875,315, the disclosures of which are incorporated herein by reference. In these patents, a composite stringer is made from triangular-shaped blocks attached to a stringer of approximately 2×6-inches in size, using a tongue-and-groove connection. In each of these disclosures, the triangular blocks that are attached to the stringer must be cut separately if the rise or run of the stairs varies from a predetermined rise and run.

Other prior art, including U.S. Pat. Nos. 2,724,466, 4,015,687, 4,106,591, 4,635,416, 4,709,520, 4,866,894, and 5,205,093, the disclosures of which are incorporated herein, disclose various brackets for use with unaltered structural lumber or steel. However, several of these have a predefined rise and run for each step or, to the extent that some adjustability is allowed, are labor-intensive and unwieldy in application.

The present invention solves all of these above-identified problems. In its preferred embodiment, it includes an anchor block to which a tread for a step may be attached, a pair of frames fixed to the anchor block so that they flank the anchor block, and markings formed on at least one of the frames to indicate a rise and a run for the step. The frames are made of metal, and the anchor block is made of plastic.

To use the bracket of the present invention, a stringer is attached to span the distance required. The stringer may be of any convenient structural material, such as 2×6-inch lumber, or metal beams of similar size. The average rise and run of the stairs is calculated by dividing the length and height of the stairs by the number of steps to be included.

Beginning at the bottom of the stringer, a bracket for the first step is placed on the stringer and attached to define the desired rise and run. The pre-formed markings on the bracket provide a convenient, accurate and easy-to-use reference to insure that the bracket is placed at the desired settings. Successive steps are defined by attaching successive brackets in the same way, beginning at the top of the prior bracket.

If needed, the carpenter can tack several brackets in position before anchoring the brackets to the stringer, thereby allowing an empirical approach. If the calculated rise and run are found to be incorrect, adjustments then may be made prior to attaching the brackets to the stringer permanently.

With the preferred embodiment of the bracket of the present invention, both the tread and riser for each step are anchored to a plastic anchor block, and yet supported on metal frames. This has the rather surprising result of providing a step that feels very solid in use, and one that is very quiet in use. It is believed that the spaced pair of frames distributes the stresses very effectively. It also is believed that the plastic anchor block cooperates with most conventional fasteners to provide an attachment that is secure and that is very resistant to squeaking or making other noises as weight is transferred onto and off the step. For optimum results, screws such as decking screws or wallboard screws should be used.

It is an object of the present invention to provide a device that is economical to manufacture, and that may be used to make stairs accurately, efficiently, and securely.

It is a further object of the present invention to provide a method of making stairs that may be practiced by carpenters having varying degrees of skill, with consistent, high-quality results.

It is a further object of the present invention to provide a method and apparatus that reduces the amount of lumber that is wasted in the manufacturing of stairs.

Additional objects and advantages of the present invention will be understood more readily after a consideration of the drawings and the Detailed Description of the Preferred Embodiment.

BRIEF DESCRIPTION OF THE DRAWINGS

FIG. 3 is a detailed isometric view of the bracket shown in FIG. 1, with the bracket shown in an exploded view and only a portion of a stringer shown.

FIG. 4 is an isometric view of a modification of the alternative embodiment of the bracket shown in FIG. 1.

DETAILED DESCRIPTION OF THE PREFERRED EMBODIMENT

Figure 1:
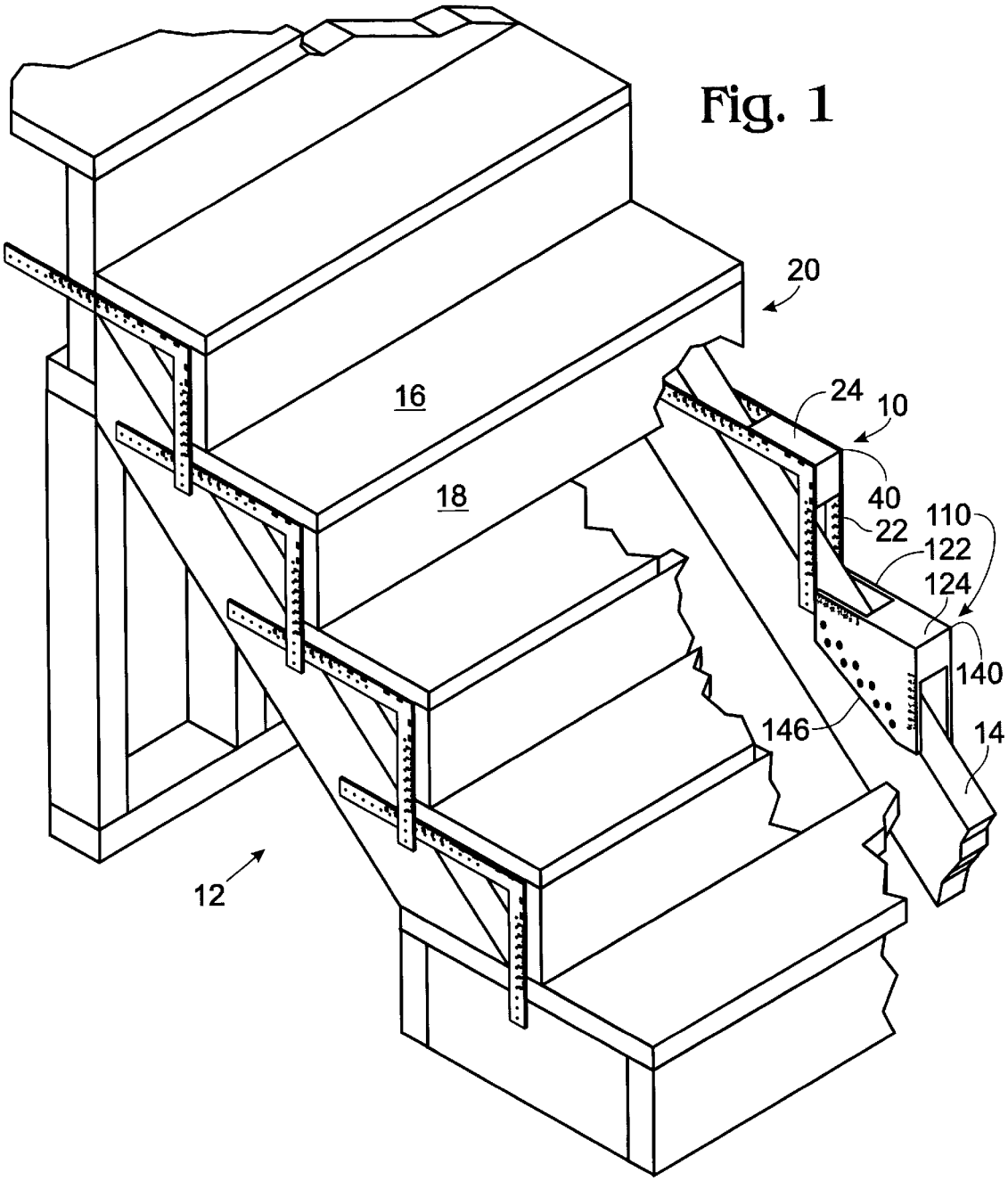
FIG. 1 is an isometric view showing stairs built using the method of the present invention, incorporating the preferred embodiment of the bracket of the present invention, with a portion of several steps being cut away to show details of the bracket and its attachment to a stringer, and to show an alternative embodiment of a bracket.

Referring to FIG. 1, a bracket 10 according to the present invention is shown as part of a stairs 12. Bracket 10 is attached to a stringer 14, which may be a conventional 2-by-6 piece of structural lumber. A tread 16 and a riser 18 then are attached to each bracket 10 to define a step 20.

Referring to the portion of FIG. 1 in which several steps 20 have been cut away to expose bracket 10, it will be seen that bracket 10 includes a pair of L-shaped frames 22 interconnected by an L-shaped anchor block 24. Preferably, frames 22 are metal and anchor block 24 is a non-squeak material such as plastic. While most plastic materials should prove suitable for anchor block 24, if bracket 10 is to be installed in extremely cold temperatures, plastics that become brittle at cold temperatures, such as ABS, are to be avoided.

An alternative embodiment of bracket 10 is shown in FIG. 1 at 110. Bracket 110 is one-piece, integrally molded, plastic. The plastic is relatively easy to cut and puncture, so it may be cut to fit with other brackets 10, as shown, or brackets 110, not shown.

Figure 2:
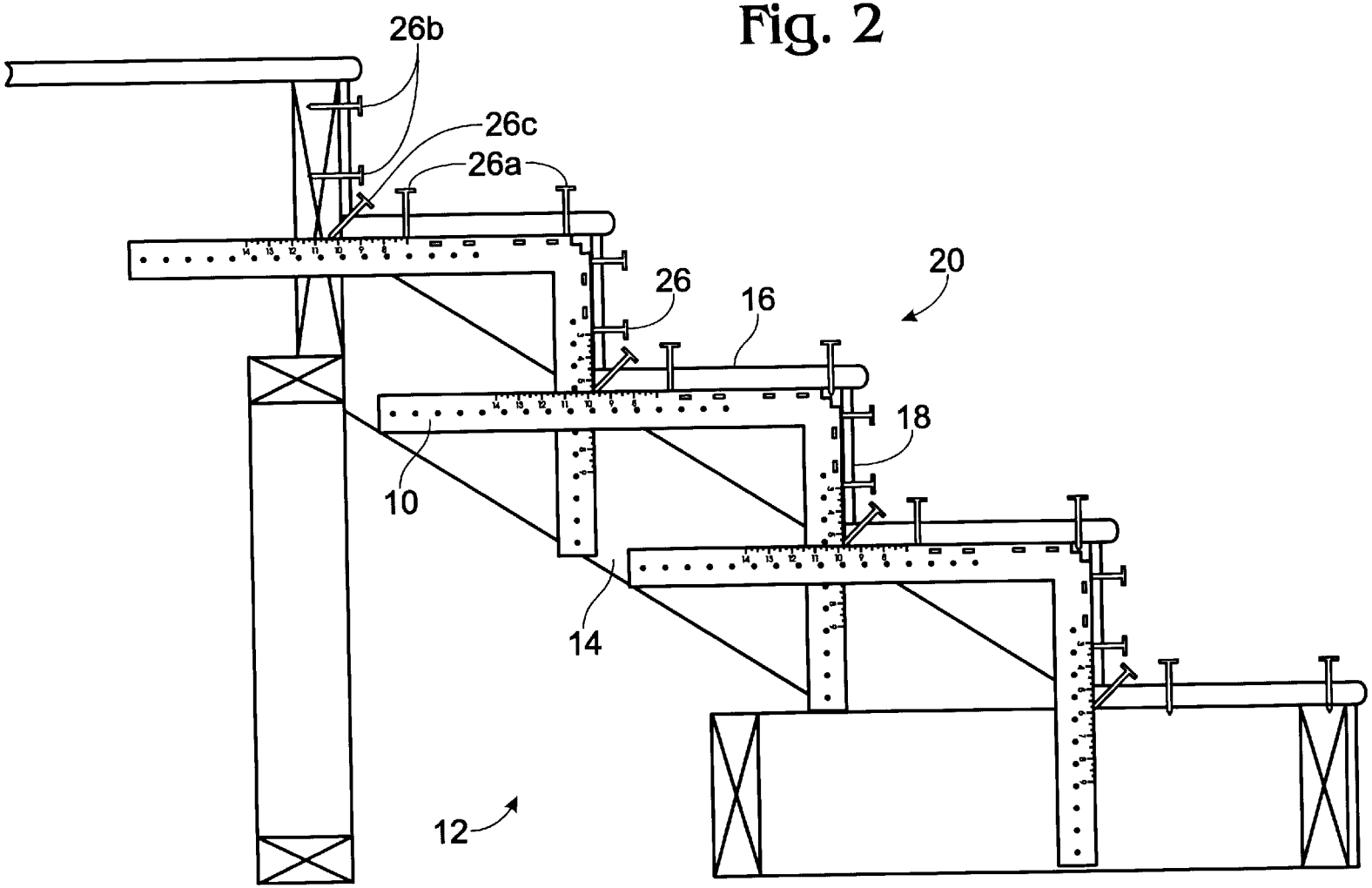
FIG. 2 is a side elevation of stairs similar to those shown in FIG. 1, with fasteners shown penetrating the tread, riser and stringer for each step.

Referring to FIG. 2, the preferred pattern of screws or other fasteners 26 for holding tread 16 and riser 18 in position are shown. For clarity, fasteners 26 are shown in FIG. 2 in solid lines, while in reality, fasteners 26 are obstructed from view as they penetrate tread 16 and riser 18. Preferably, at least two fasteners 26 extend through tread 16 or riser 18 and into anchor block 24, as indicated by fasteners 26*a* and 26*b*, respectively. At least one additional fastener 26 also extends through tread 16 and into stringer 14, as indicated by fasteners 26*c*. Wallboard screws and decking screws have been found to work well as fasteners 26.

While referring to FIG. 2, it will be noted that the layup of brackets 10 shown in FIG. 2 is such that the first bracket attached to stringer 14 was at the top of stairs 12, with succeeding brackets placed working down the stairs. This shows the versatility of bracket 10. It also will be understood that one of frames 22 must be cut off or bent adjacent the top of stairs 12, and another must be cut or bent adjacent the bottom of stairs 12. The ability to bend and cut frames 22 provides exceptional freedom to the craftsperson making stairs, in that bracket 10 may be modified as needed to construct curved, flared or other special-situation stairs.

Turning now to FIG. 3, an exploded view of bracket 10 is shown, in association with a portion of stringer 14. Frames 22 have been labeled as frame 22*a* and frame 22*b*. Each frame 22 includes an outer face, such as is seen on frame 22*a*, and an inner face, such as seen on frame 22*b*. Anchor block 24 is coupled between the inner faces of frames 22*a* and 22*b*, with positive coupling being provided by protrusions 28 extending outwardly from frames 22*a* and 22*b*, and corresponding depressions 30 that match with or are formed by protrusions 28 in anchor block 24.

Each frame 22 includes a horizontal member or run leg 32 and a vertical member or rise leg 34. Run leg 32 defines a frame run 32*a* and rise leg 34 defines a frame rise 34*a* for bracket 10. The top edge of run leg 32 forms a tread-supporting portion 36 for bracket 10, and the front edge of rise leg 34 forms a riser-supporting portion 38 for bracket 10.

The intersection of top edge 36 and front edge 38 defines an intersection point 40. It will be noted that the embodiment of bracket 10 shown in FIG. 3 varies slightly from that shown in FIG. 1, because a cutout 42 is formed adjacent intersection point 40. Cutout 42 exposes a small portion of anchor block 24 to access from the side of bracket 10. This is particularly useful if molding or fascia is to be nailed to the side of step 20.

Markings 44 are provided adjacent top edge 36 and front edge 38. Markings 44 provide indicia of the distance from intersection point 40 along edges 36 and 38. They therefore provide reference for the exact position of bracket 10 relative to stringer 14, with the desired run being set at the intersection of top edge 36 and stringer 14, and the desired rise being set at the intersection of front edge 38 and stringer 14.

Also shown in FIG. 3 are holes or apertures 46 formed in frames 22. Holes 46 are used in combination with fasteners 48 to attach bracket 10 to stringer 14. Common joist-hanger nails have been found to work particularly well.

Anchor block 24 includes a tread-engagement surface or top edge 50 that defines a run 50*a* for anchor block 24. Anchor block 24 also includes a riser-engagement surface or front edge 52 that defines a rise 52*a*. The thickness 54 of anchor block 24 is matched to stringer 14 so that the inner surfaces of frames 22*a* and 22*b* jacket or engage stringer 14 therebetween.

Turning now to FIG. 4, a molded bracket 110 similar to bracket 110 in FIG. 1 is shown in detail. Bracket 110 includes flanges 122 that are molded integrally with a central anchor block 124. Referring briefly to FIG. 1, it will be seen that flanges 122 generally are triangular in shape. Other elements of bracket 110 corresponding to bracket 10 have been labeled by adding 100 to the reference character for the elements of bracket 10, as discussed above with respect to FIG. 3.

In the embodiment of bracket 110 shown in FIG. 4, a portion of flanges 122 has been removed to define a separately extending run leg 132. Run leg 132 is small enough that it is cut easily with tin snips or similar cutters. This allows each bracket 110 to be abutted to the front edge of the bracket immediately above bracket 110. In FIG. 1, this is shown by bracket 110 abutting front edge 38 of bracket 10. Prior to being cut, bracket 110 in FIG. 1 defined a bracket run approximately equal in length to bracket run 132*a* in FIG. 4.

In FIG. 1, bracket 110 is shown with preformed fastener holes 146. However, the thickness of flange 122 generally is less than 1/10th of an inch, and preferably approximately 0.080-inches, through which joist-hanger nails 48 or other conventional fasteners such as 1-inch staples may penetrate easily. Therefore, bracket 110 in FIG. 4 is shown without any holes.

Tread 16 and riser 18 should be attached to bracket 110 using the pattern of fasteners 26 shown in FIG. 2. It particularly is important that at least one fastener 26 adjacent each bracket 110 extend through tread 16 and into stringer 14, as shown in FIG. 2 at 26*c*. There is little material of run leg 132 that overlaps stringer 14, so it is difficult to anchor this portion of bracket 110 firmly to stringer 14.

Despite the requirement of a specific attachment pattern for fasteners 26 when using bracket 110, the resulting step 20 is surprisingly strong. Tests of a version of bracket 110 made of ABS plastic proved that bracket 110 withstands a downward load of approximately 1,000-pounds. A complete step 20 made using bracket 110 of FIG. 4 and the pattern of fasteners 26 of FIG. 2, and it withstood a downward load of several times this amount. When this specific embodiment of step 20 failed under this test, the cause of failure appeared to be fasteners 26, and not bracket 110.

Given the above-identified elements of the various embodiments of the bracket of the present invention, the invention also includes a method of assembling stairs 12. It includes the following steps:

selecting a desired tread distance and rise distance for stairs 12 to be built;

providing anchor block 24, which has first edge 50 and a second edge 52 disposed at a right angle to first edge 50;

providing plural generally L-shaped structural supports 22 each having an inner face, an outer face and first leg 32 and second leg 34, with first leg 32 and second leg 34 being disposed at right angles to each other and containing measurement indicia 44 for indicating the selected tread and riser distances;

retaining structural supports 22 in a fixed, spaced relationship with each other by coupling anchor block 24 between the inner faces of supports 22 so that first edge 50 of anchor block 24 and first legs 32 of the supports collectively form a tread-receiving portion and second edge 52 of anchor block 24 and second legs 34 of the supports collectively form a riser-receiving portion;

fastening the tread receiving portions and the riser-receiving portions to a first elongate stringer 14 to define the desired tread and riser distances;

repeating the above steps with respect to a second stringer 14;

mounting tread 16 to the tread-receiving portions; and mounting riser 18 to the riser-receiving portions.

While the present invention has been shown and described by reference to the preferred embodiment, it will be apparent to those skilled in the art that other changes in form and detail may be made therein without departing from the spirit and scope of the invention defined in the appended claims.

We claim:

1. A bracket for use in manufacturing a step supported by a stringer, the bracket comprising:

an anchor block to which a tread for a step may be attached;

a pair of L-shaped frames flanking the anchor block and fixed thereto;

pre-formed markings formed on at least one of the frames, the markings indicating a rise and a run for the step.

2. The bracket according to claim 1, wherein the frames are made of metal, and the anchor block is made of plastic.

3. The bracket according to claim 1, wherein the anchor block is L-shaped.

4. The bracket according to claim 1, wherein at least one of the frames defines a frame rise and frame run, the anchor block defines a block rise and block run, and the frame run is between approximately two and five times the block run.

5. The bracket according to claim 1, wherein at least one of the frames defines a frame rise and frame run, the anchor block defines a block rise and block run, and the frame rise is between approximately two and five times the block rise.

6. The bracket according to claim 1, wherein at least one of the frames defines a frame rise and frame run, the anchor block defines a block rise and block run, and the frame rise is approximately three times the block rise.

7. The bracket according to claim 1, wherein the frames and anchor block are integrally molded.

8. A stair support system, comprising:

plural L-shaped structural frames, each having an inner face, an outer face, and first and second legs disposed at approximately right angles to each other so that each leg may be cut or bent independent of the other leg, as needed; and an anchor block coupled between the inner faces of the structural frames to retain the frames in a corresponding, yet spaced rigid relationship to each other;

wherein the outer face of at least one of the frames includes measurement indicia for identifying a selected distance on the frames.

9. The stair support system of claim 8, wherein the anchor block is constructed of injection-molded plastic.

10. A stair support, comprising:

a first L-shaped member having a tread-supporting section and a riser-supporting section integrally connected to and disposed at a right angle to the tread-supporting section at an intersection point, with pre-formed measurement indicia originating at the intersection point and extending along the tread-supporting section for selecting a desired tread length or extending along the riser-supporting section for selecting a desired riser length, or both;

a second L-shaped member having a tread-supporting portion and a riser-supporting portion integrally connected to and disposed at a right angle to the tread-supporting portion at an intersection point;

an anchor block coupled to the first and second members to maintain the members in a spaced configuration with respect to each other.

11. The support of claim 10, wherein the anchor block has a tread-engagement surface intermediate the tread-supporting portions of the first and second members, and a riser-engagement surface intermediate the riser-supporting portions of the first and second members.

12. The support of claim 11, wherein the first and second members are configured to jacket or engage therebetween an elongate stringer to define tread and riser distances of a stair.

13. The support of claim 10, wherein the first member includes both measurement indicia originating at the intersection point and extending along the tread-supporting portion for selecting a desired tread length, and measurement indicia originating at the intersection point and extending along the riser-supporting portion for selecting a desired riser length.

14. The support of claim 10, wherein the anchor block is constructed of a molded plastic.

15. The support of claim 10, wherein the first member is cutaway adjacent the intersection point to define a cutout and expose a portion of the anchor block to access from an outer surface of the first member opposite the anchor block.

16. The support of claim 10, wherein the first and second members include apertures through which a fastener may be inserted to fasten the members to a stringer.

* * * * *